US006951696B2

(12) United States Patent
Ozaki

(10) Patent No.: US 6,951,696 B2
(45) Date of Patent: Oct. 4, 2005

(54) TRANSFER SHEET

(75) Inventor: Masahiro Ozaki, Sakaide (JP)

(73) Assignee: Kabushiki Kaisha Ozaki Screen, Kagawa (JP)

( * ) Notice: Subject to any disclaimer, the term of this patent is extended or adjusted under 35 U.S.C. 154(b) by 191 days.

(21) Appl. No.: 09/993,546

(22) Filed: Nov. 27, 2001

(65) Prior Publication Data

US 2002/0068155 A1 Jun. 6, 2002

(30) Foreign Application Priority Data

Dec. 6, 2000 (JP) ..... 2000-371824

(51) Int. Cl.[7] ..... B41M 3/12

(52) U.S. Cl. ..... 428/914; 428/211; 428/448; 428/423.1; 428/195.1; 430/27

(58) Field of Search ..... 428/914, 211, 428/448, 423.1, 195; 430/27

(56) References Cited

U.S. PATENT DOCUMENTS 4,103,053 A * 7/1978 Barehas ..... 428/41.6
5,869,167 A * 2/1999 Takeuchi et al. ..... 428/195.1
5,981,077 A * 11/1999 Taniguchi ..... 428/447
6,017,636 A * 1/2000 Tada et al. ..... 428/423.1
6,037,090 A * 3/2000 Tanaka et al. ..... 430/109.4
6,045,904 A * 4/2000 Torikoshi et al. ..... 428/334
6,203,896 B1 * 3/2001 Nomura ..... 428/332
6,245,479 B1 * 6/2001 Etzel ..... 430/200
6,296,983 B1 * 10/2001 Gula et al. ..... 430/201
6,497,781 B1 * 12/2002 Dalvey et al. ..... 156/234

FOREIGN PATENT DOCUMENTS

| | | |
|---|---|---|
| JP | 3-106396 | 11/1991 |
| JP | 03-106396 | * 11/1991 |
| JP | 5-177996 | 7/1993 |
| JP | 05-177996 | * 7/1993 |
| JP | 2840918 | 10/1998 |

* cited by examiner

*Primary Examiner*—Rena Dye
*Assistant Examiner*—Tamra L. Dicus
(74) *Attorney, Agent, or Firm*—Ronald R. Snider; Snider and Associates

(57) ABSTRACT

A transfer sheet which uses a toner image, obtained by an electrophoto copying machine. Designs, patterns, photos and letters are fixed on a base sheet through a hair-like transplant sheet having a parting agent and a short fiber layer is provisionally bonded on the hair-like transplant sheet is clearly transferred with the short fiber layer over a subject receiver of a cloth or a wooden panel. The hair-like transplant sheet having the parting agent furnished with an acrylic solvent cohesive layer is provisionally bonded on a base sheet, and the fixed toner image is obtained by the electrophoto copying machine image on the short fiber layer. Finally, an acrylic ester resin binder layer is placed on the short fiber having the fixed toner image, while a hot-melt adhesive layer is placed on the binder layer.

6 Claims, 4 Drawing Sheets

TRANSFER SHEET

This present disclosure relates to subject matter contained in Japanese Patent Application No. 2000-371824 (filed on Dec. 7, 2000) which is expressly incorporated herein by reference in its entirety.

BACKGROUND OF THE INVENTION

1. Field of the Invention

This invention relates to a transfer sheet, wherein a hair-like transplant sheet is furnished with a parting agent. The hair-like sheet has a short fiber layer which is provisionally bonded with an adhesive onto a base sheet. Over the short fiber layer, designs, patterns and letters are fixed by an electrophoto copying machine using a toner. The fixed toner image over the short fiber layer is effectively and smoothly transferred on cloth, wooden panels and so on.

2. Description of the Prior Art

The present inventor has already provided a transfer sheet developed by Japanese Patent No. 2840918 which discloses a sheet furnished with a parting agent placed on a base sheet, a toner image layer which is fixed on the sheet by an electrophoto copying machine using a toner, at least an acrylic urethane resin layer which is placed on the toner image layer, and a hot melt adhesive layer which is placed on the acrylic urethane resin layer.

In the transfer sheet disclosed in this Japanese Patent No. 2840918, because the toner image layer can be fixed on the sheet furnished with a parting agent by the electrophoto copying machine which is simple, when compared with a screen printing, an offset printing, a gravure printing and other similar printing methods, which need complicated process plates or special printing techniques, this transfer sheet does not need such process plates or special printing techniques, and thus production costs come very inexpensive.

Among marketed transfer sheets, there already exists another transfer sheet, wherein an image layer is formed on a short fiber layer placed on a base sheet via a tacky agent, where the short fiber layer is composed of a hair-like transplant sheet furnished with a parting agent and which is provisionally bonded with the hair-like transplant sheet.

An example of this transfer sheet is provisional Japanese Patent Application Publication No. 5-177996 which discloses a thermo adhesive layer having a design which is provisionally bonded on a fundamental material furnished with a parting agent such as a paper or plastic film. Another adhesion layer with very strong adhesion and elasticity is prepared over the thermo adhesive layer. A transplant hair-like layer is established by a short fiber selected among cotton, nylon resin, acrylic resin, polyester resin which is formed on the adhesive layer, and decorative detailed materials such as metallic powders, foil pieces, resin grains and colored glass pieces are prepared on the upper surface of the transplant hair-like layer. A masking viscous tape which loses its viscosity when temperature increases by heat is overlaid on the transplant hair-like layer, and finally a thermal transfer applique is obtained.

Provisional Japanese Utility Model Publication No. 3-106396 discloses a thermal transfer sheet which comprises a base sheet;

a provisional layer of short fibers formed over the base sheet;

a short fiber layer prepared by transplanting hair-like over the provisional layer;

a covering layer furnished on one part of the short fiber layer;

a different surface material layer formed on the covering layer;

a design fixed layer formed on the other part of the short fiber layer where the covering layer is not furnished and also formed on the different surface material layer and;

a hot-melt adhesive layer formed on the design fixed layer, wherein said provisional layer of short fibers is to be peeled off against the short fiber of the short fiber layer and also is the adhesive on the base sheet. The covering layer is the different surface material layer and also is to be the adhesive on the provisional layer of the short fibers.

A thermal transfer sheet where an image is fixed on a marketed short fiber layer furnished with a hair-like transplant sheet and a parting agent sheet is not obtained by an electrophoto copying machine using a toner. The image is obtained by a screen printing machine. The thermal transfer applique of said Provisional Japanese Patent Application publication No. 5-177996 and the thermal transfer sheet of said provisional Japanese Utility Model Publication No. 3-106396 adopt screen printing to obtain the design or the image.

SUMMARY OF THE INVENTION

The present inventor tried to fix a toner image on a short fiber layer equipped of a hair-like transplant sheet furnished with a parting agent, by using an electrophoto copying machine, in the same manner as disclosed in Japanese Patent No. 2840918 and the also proposed details of the same in a Provisional Japanese Patent Application Publication No. 2000-289392. However, these trials have had problems. The toner images obtained thereby on the marketed short fiber layer were not clear and a part of transferred image on the short fiber layer may remain on a base sheet. This is because the toner could not reach the deep bottom end of the short fiber layer of the hair-like transplant sheet.

In order to resolve the above problem, the inventor made various experiments and tests, and he found that the marketed hair-like transplant sheet was of inferior conductivity, and this inferior conductivity caused the toner not to reach deeply into the short fiber layer. Accordingly, through further tests and research, Applicant tried to obtain a proper cohesive agent of high conductivity to be used for the hair-like transplant sheet. Applicant finally found that, if he adopted an acrylic solvent cohesive layer on the hair-like transplant sheet, the conductivity on the sheet is improved so that the toner penetrated deeply into the short fiber layer, whereas the toner image was efficiently fixed and the clear image was formed.

Then, the short fiber layer of the hair-like transplant sheet furnished with the parting agent is provisionally bonded on the base sheet via the acrylic solvent cohesive layer, and thus the toner image is fixed and the clear image is obtained. Over the short fiber layer on which the toner image is fixed, an acrylic urethane resin layer is formed in the same manner as the transfer sheet disclosed in Japanese Patent No. 2840918. Further, a hot-melt adhesive layer is placed thereon and this obtained transfer sheet was tested many times by transferring by a heating and pressing method on the cloth subject. However, in this experiment, the short fiber layer was found to remain partially on the base sheet, which did not attain the present purpose.

Now, this inventor made various trials and errors to obtain a proper resin layer which can satisfy the transferring procedures. As a result, when an acrylic ester resin layer is adopted in stead of the acrylic urethane resin layer, the acrylic ester resin layer in the heating and pressing method intertwines with the short fiber layer as a binder while the acrylic ester resin layer overcomes the adhesive force of an acrylic solvent cohesive layer, whereon the short fiber layer is efficiently transferred onto the cloth subject without sticking to the base sheet at all. A hot-melt adhesive layer is placed on the acrylic ester resin layer.

In view of explained procedures, this invention has an object to provide a transfer sheet comprising:

a hair-like transplant sheet comprising an acrylic solvent adhesive layer a parting agent on which a short fiber layer is provisionally bonded which is placed onto a base sheet;

a toner image fixed on the short fiber layer with a toner by an electrophoto copying machine;

at least one acrylic ester resin layer binder layer placed on the short fiber having the toner image; and a hot-melt adhesive layer also placed on the binder layer;

wherein the toner image and the short fiber layer can be transferred on a subject receiver to be transferred.

The present invention has another object to provide a transfer sheet comprising:

a hair-like transplant sheet furnished an acrylic solvent cohesive layer parting agent on which a short fiber layer is provisionally bonded which is placed onto a base sheet;

a toner image fixed on the short fiber layer with a toner by an electrophoto copying machine;

a transparent acrylic ester resin layer as a binder layer placed on the short fiber having the fixed toner image;

a colored acrylic urethane resin layer placed on the transparent binder layer;

a hot-melt adhesive layer also placed on the colored layer; and wherein the toner image and the short fiber layer can be transferred on a subject receiver.

The invention has further an object to provide a transfer sheet wherein a toner image and a short fiber layer can be transferred on a subject receiver to be transferred when a color electrophoto copying machine is used to make the toner image.

BRIEF DESCRIPTION OF THE DRAWINGS

FIG. 2A shows a hair transplant sheet furnished with a parting agent, wherein an adhesive is applied on a base sheet as a solvent cohesive layer; and a short hair-like fiber layer is implanted and is simultaneously and provisionally bonded on the solvent cohesive layer.

FIG. 2B shows a toner image such as designs, patterns, photos and letters which is fixed on the short fiber of the hair-like transplant sheet with a parting agent.

FIG. 2C shows a transparent binder layer placed on the short fiber with a screen printing method.

FIG. 2D shows a hot-melt adhesive layer placed on the transparent binder which completed the transfer sheet.

FIG. 3A shows the hot-melt adhesive which is melted and bonded on the subject receiver by heating or pressing methods.

FIG. 3B shows the toner image which is transferred on the subject receiver when the base sheet is peeled off of the transfer sheet.

DESCRIPTION OF PREFERRED EMBODIMENTS

The example of the first embodiment of the present invention is now explained with reference to FIG. 1, FIG. 2 and FIG. 3.

Figure 1:
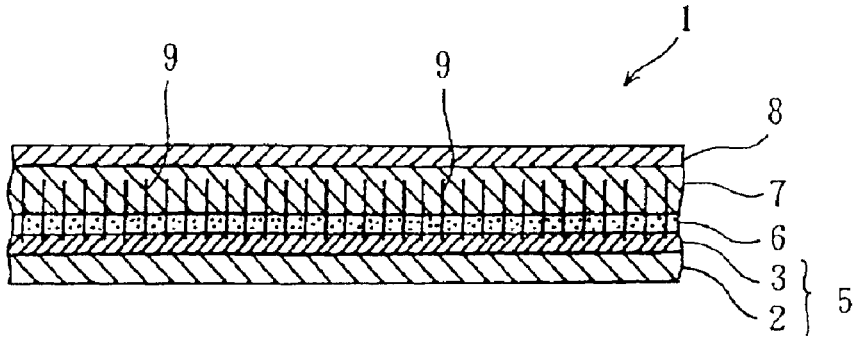
FIG. 1 is a vertical sectional view of a transfer sheet developed by the present invention.

FIG. 1 is a vertical sectional view of a transfer sheet, and FIG. 2 is explanatory and vertical sectional views for a process of the present transfer sheet as shown at the FIG. 1, while FIG. 3 is also explanatory and vertical sectional views for a transferring method of the transfer sheet as shown at the FIG. 1.

In these drawings, the numeral 1 is a transfer sheet which comprises a hair-like transplant sheet furnished with a parting agent (5) on which a short fiber layer (4) is provisionally bonded onto a base sheet (2) via an acrylic solvent cohesive layer (3). A toner image (6) is fixed by an electrophoto copying machine using a toner on the short fiber layer (4) of the hair-like transplant sheet (5). A transparent acrylic ester resin binder layer (7) is placed on the short fiber layer (4) having the toner image (6), and a hot-melt adhesive layer (8) is placed on the transparent binder (7).

The hair-like transplant sheet furnished with a parting agent (5) is basically constituted by three elements, such as the base sheet (2) which is made from paper or plastic films, the solvent cohesive layer (3) where the acrylic solvent cohesive is applied on the base sheet (2), the short fiber layer (4) where a short fiber (9) selected from a group of nylon, polyester, acryl and/or rayon is transplanted and provisionally bonded thereon. This transplant sheet (5) is now obtained on the open market. As our further explanation, the expression of "is transplanted and provisionally bonded" means one process, that is to say, the explained process is one simultaneous procedure.

As the acrylic solvent cohesive layer (3), the proper material has been sold in the market, and as our recommendation, the commodity name of "Lintec MF5" distributed by Lintec Corporation or the commodity name of "Application 1" also distributed by the same corporation can be used.

The toner image (6) is produced by any well-known electrophoto copying machine, preferably by a color copying machine, for copying designs, patterns, photos and letters.

As the transparent acrylic ester resin layer (7), the commodity name of "NKBinder AS-50" distributed by Shin Nakamura Chemical Industry Kabushiki Kaisha or the commodity name of "Dixel" distributed by Dainippon Ink Chemical Industry Co., Ltd. is recommended.

As the hot-melt adhesive layer (8), any hot-melt type adhesive including mainly the materials of polyester, nylon or urethane prepared in prior arts of the transfer sheet can be used. However, the inventor recommends the following as the proper adhesive agents: The commodity name of "Diamid" including mainly polyester material which is distributed by Dicel Chemical Kabushiki Kaisha, or else the commodity name of "Platamid" including mainly nylon material which is distributed by Lirusan Co., Ltd.

Now, the production method for the transfer sheet (1) is explained.

Figure 2A:
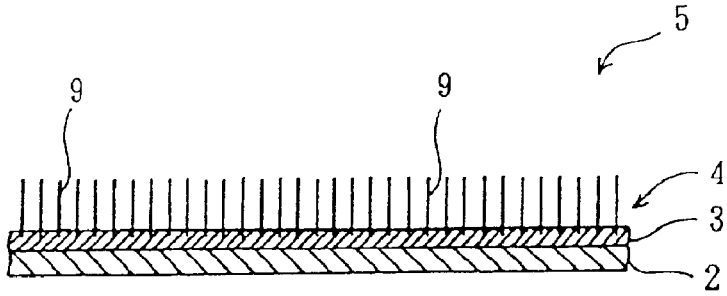
FIG. 2A–FIG. 2D are explanatory and vertical sectional views showing a flow diagram of developing the transfer sheet.
Figure 2B:
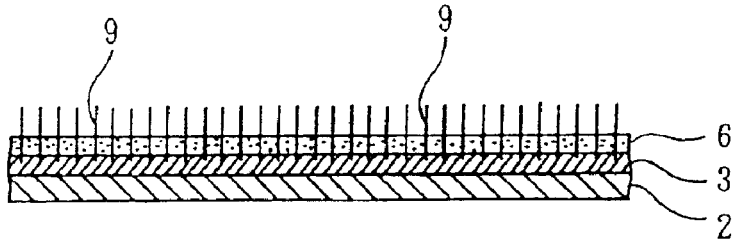
Figure 2C:
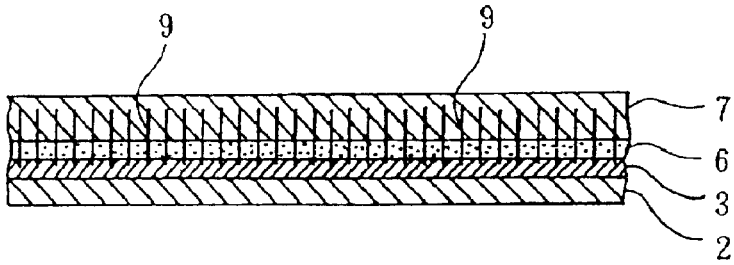
Figure 2D:
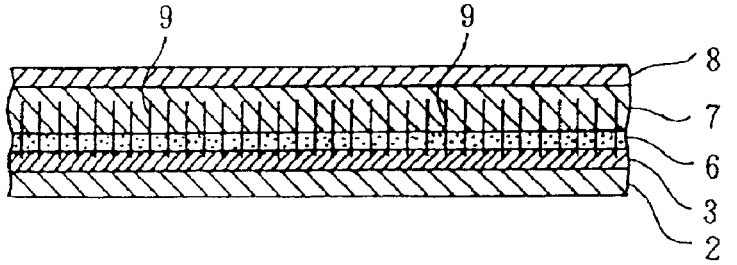

As shown in FIG. 2A, the acrylic solvent cohesive agent is applied on an acrylic solvent cohesive layer (3) and it is placed on a base sheet (2). Then, a short fiber (9) is transplanted and bonded simultaneously to form a short fiber layer (4) and thus a hair-like transplant sheet (5) furnished with the parting agent is provided. Next, as shown in FIG. 2B, a toner image (6) is to be fixed on the short fiber layer (4) as the image of designs, patterns, photos, and letters which are obtained by an electrophoto copying machine. Then, as shown in FIG. 2C, an transparent acrylic ester resin binder layer (7) is placed on the short fiber layer (4) having the toner image (6) by a screen printing method. As a final process, as shown in FIG. 2D, a hot-melt adhesive layer (8) is placed on the transparent binder layer (7) by the screen printing, and thus the transfer sheet (1) is obtained.

In the transfer sheet (1) developed by the present invention, for the acrylic solvent cohesive layer (3) the acrylic solvent agent having high conductivity is adopted instead of normal adhesive agent, and accordingly when the toner image (6) is fixed on the hair-like transplant sheet furnished with the parting agent (5) by the electrophoto copying machine. The hair-like transplant sheet (5) furnished with the parting agent strongly absorbs the toner, and as a result the toner enters deeply into the short fiber layer (4), so that the toner image (6) is efficiently fixed to obtain a clear image thereof.

At the same time, the transparent acrylic ester resin binder layer (7) is placed on the short fiber layer (4) having the toner image (6). The binder layer (7) entwines around each short fiber (9) forming the short fiber layer (4) when heated or pressed. The binder layer (7) also penetrates into the toner image (6) which enters each gap formed by each short fiber (9). Both the short fiber layer (4) bonded on the hair-like transplant sheet (5) and the toner image layer (6) fixed on the short fiber layer do not remain in the base sheet (2). The fiber layer (4) is, therefore, provisionally bonded to the base sheet (2) by the cohesive layer (3). The toner image (6), the short fiber (4) the cohesive layer (3) and the base sheet (2) are transferred, as shown in FIG. 3B, onto a receiver.

Next, the transferring method of a transfer sheet (1) is now explained.

Figure 3A:
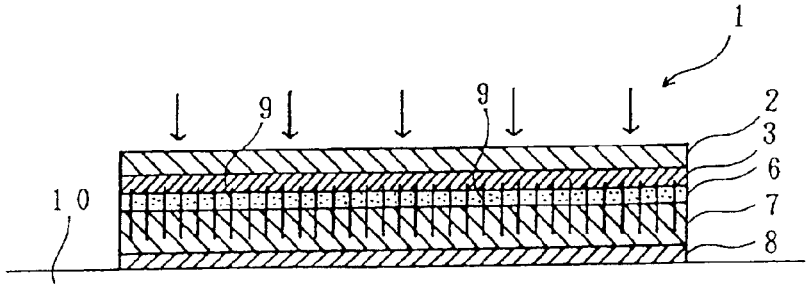
FIG. 3A–FIG. 3B are explanatory and vertical sectional views showing a transferring method of the transfer sheet onto a subject receiver.

With reference to FIG. 3A, surface of a hot-melt adhesive layer (8) on the transfer sheet (1) is placed tightly on a subject receiver (10) made of cloth or a wooden panel, and the transfer sheet (1) is heated or pressed on the subject receiver at a fixed temperature or fixed time, and then the hot-melt adhesive agent is melted so that the transfer sheet (1) is transferred onto the subject receiver (10). During this heating or pressing time, a transparent binder layer (7) enters deeply into each short fiber (9) of the short fiber layer (4) and entwines around each short fiber (9) and also the binder layer (7) penetrates into a toner image (6) and stabilizes the toner image thereof.

Figure 3B:
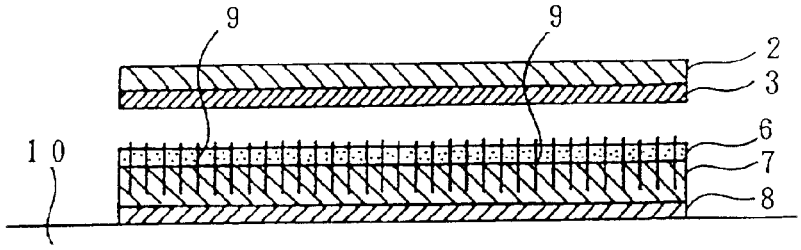

As shown in FIG. 3B, a base sheet (2) of the transfer sheet (1) is peeled off. Then, because the transparent binder layer (7) force holding the toner image (6) onto the short fiber layer (4) is stronger than that of the acrylic solvent adhesive layer (3) which bonds provisionally the toner image (6) onto the short fiber layer (4), the short fiber layer (4) and the toner image (6) is parted from the acrylic solvent adhesive layer and is transferred onto the transparent binder layer (7). Therefore the toner image (6) is efficiently transferred on the subject receiver.

Now, the example of the second embodiment of the present invention is explained with reference to FIG. 4 and FIG. 5

Figure 4:
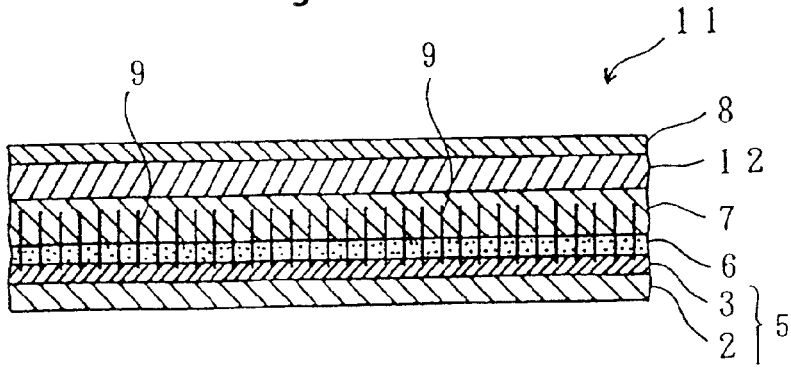
FIG. 4 is a vertical sectional view of a transfer sheet developed by another embodiment of this invention.
Figure 5:
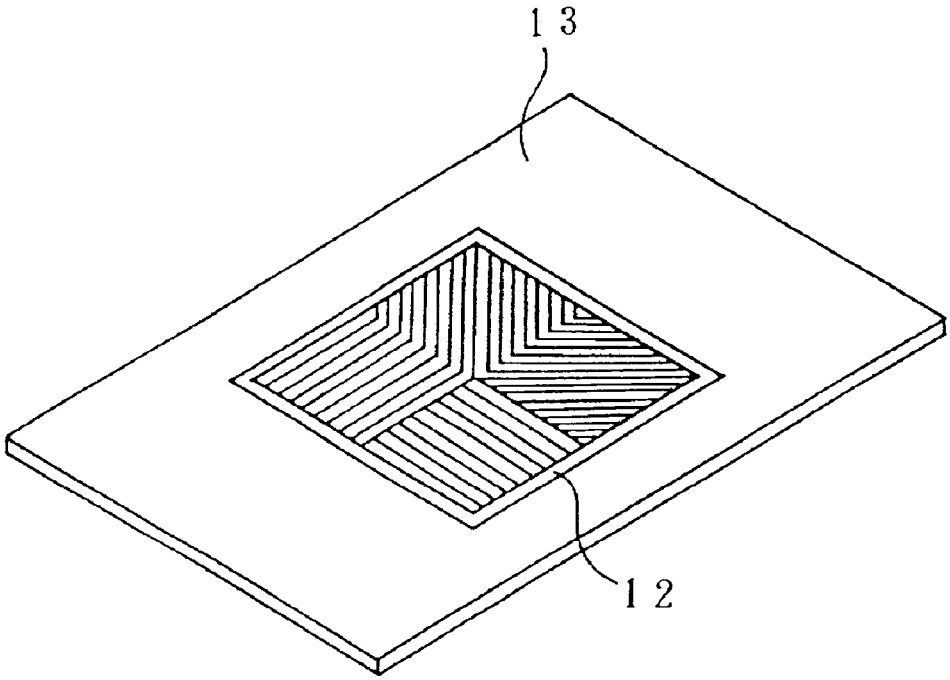
FIG. 5 is a perspective view of the subject receiver cloth where the design is already transferred.

With reference to FIG. 4, all numerals used in from FIG. 1 to FIG. 3 are exactly same as already explained except the numeral 11.

This numeral 11 is a transfer sheet comprising as below:

a hair-like transplant sheet having a parting agent (5) on which a short fiber layer (4) is provisionally bonded onto a base sheet (2) via an acrylic solvent cohesive layer (3);

a toner image (6) which is fixed by an electrophoto copying machine using a toner on the short fiber layer (4) of the hair-like transplant sheet having the parting agent (5);

a transparent acrylic ester resin binder layer (7) which is placed on the short fiber layer (4) having the toner image (6);

a colored acrylic urethane resin layer (12) which is placed on the transparent acrylic ester resin binder layer (7); and a hot-melt adhesive layer (8) which is placed on the colored acrylic urethane resin layer (12).

As the colored acrylic urethane layer (12), it is now marketed, and the inventor recommends; the commodity name of "Ryude-W.Binder-UF-701TL" distributed by the Dainippon Ink Chemical Industry Co., Ltd is mixed with the commodity name of "New Coat K2" distributed by Shin Nakamura Chemical Industry Kabushiki Kaisha, and a colored pigment for instance white titanium powder pigment is added to this mixture for coloring. The coloring should be selected properly in accordance with the color of the subject receiver (10) and that of the toner image (6).

In the present transfer sheet (11), because the colored resin layer (12) is placed between the transparent binder layer (7) and the hot-melt adhesive layer (8), after the toner image (6) is placed on the colored resin layer (12), the toner image (6) will not be influenced by the color of the subject receiver (10). The colored resin layer (12) prevents the toner image (6) from discolouring the receiver (10).

Between the toner image (6) and the colored resin layer (12), there is the transparent binder layer (7). The colored resin layer (12) enters into the toner image (6) through the binder (7) so that the color of the toner image (6) and that of the colored resin layer (12) are prevented from mixing a distinct colored image through the transferring procedure is obtained.

When a wider colored resin layer (12) than the toner image (6) is placed over the toner image (6) via the transparent binder layer (7), an extra outline is formed over the toner image (6) after the transferring procedure.

The preferred embodiment for the above second example is explained below:

A base sheet (2) is around 100 microns thick and made of a polyester film of "Lintec PET75" distributed by Lintec Corporation is prepared, on which an acrylic solvent cohesive layer of "Lintec MF5" distributed by the same corporation is placed to obtain the acrylic cohesive layer (3) approximately 20 microns thick. Then, on the cohesive layer (3), white and semi-transparent rayon piles with one denier diameter distributed by Kabushiki Kaisha Kanahara Piles Industry are transplanted and provisionally bonded, so that a hair-like transplant sheet (5) having a parting agent with the cohesive layer (3) is provided forming a short fiber layer (4) which is about 400 microns thick.

Then, an original color design which is in square shape comprising red, yellow, blue and black colors is copied by "Imagio Color 4000" distributed by Ricoh Co., Ltd. with red color toner of "63-6209", yellow color toner of "63-6208", blue color toner of "63-6210" and black color toner of "63-6207" all distributed by Ricoh Co., Ltd. on the short fiber layer (4) of the hair-like transplant sheet. The toner image (6) is about 10 microns thick and is bonded to the transparent binder (7) and the short fiber layer (4).

Further, on the toner image (6), a transparent acrylic ester resin binder layer (7) of "NKBinder AS-50" which is about 20 microns thick and distributed by Shin Nakamura Chemical Industry Kabushiki Kaisha is placed in accordance with a square shape designed which is copied by a screen printing. Then, three elements such as an acrylic copolymer resin of "New Coat K-2" distributed by Shin Nakamura Chemical Industry Kabushiki Kaisha, an urethane resin of "Ryudye-W.Binder-UF-701TL" distributed by Dianippon Ink Chemical Industry Co., Ltd., and a white titanium powder pigment, are mixed together at ratio 45:45:10, and this mixture is sprayed a little bit wider than the copied design in square shape as a white resin layer (12) approximately 50 microns thick, and this white resin layer (12) is placed on the obtained transparent binder layer, and on this white resin layer (12), a polyester hot-melt adhesive of "Diamid" distributed by Dicel Chemical Kabushiki Kaisha is sprayed by screen printing in accordance with the shape of the white resin layer (11), and after the hot-melt adhesive layer (8) which is approximately 50 microns thick is placed thereon, thus a transfer sheet (11) is now obtained with reference to FIG. 4.

In succession, when the surface of the hot-melt adhesive layer (8) with the transfer sheet (11) is tightly stuck on a cotton cloth (13) of the subject receiver (10), the transfer sheet (11) is heated at 155° C. and pressed at 200 g/cm$^2$ for 15 seconds with a press machine, the commodity number of "SC-FA-4500" distributed by Sanyei Kabushiki Kaisha. After this procedure, when the base sheet (2) is peeled off, the short fiber layer (4) corresponding with the hot-melt adhesive layer (8) is separated from the acrylic solvent cohesive layer (3), and as shown in FIG. 5, the design in square shape is transferred on the cotton cloth (13) with a square white resin frame. A visual observation is performed on the surface of the acrylic solvent cohesive layer (3) for the separated short fiber layer (4), and any short fiber (9) is not found as remained.

The durability of the cloth subject receiver (13) after the transferring procedure is finished is performed under Japan Industry Standard (JIS) and the test result shows:

Washing Test under No.JIS L 0844-A-3 proves at Class 4 or 5.

Friction Test in drying condition under No.JIS L 0849-Model 11 Testing machine proves at Class 5.

Dry Cleaning Test under No.JIS L 0860 for petrochemical agents proves at Class 5.

In the JIS test results, there are five classes from 1 to 5, and the bigger figure shows its stronger quality Class 5 means the strongest durability.

The present invention provides:

a toner used in an electrophoto copying machine which enters deeply into a short fiber layer of a hair-like transplanted sheet having a parting agent;

a toner image which is sufficiently fixed to form a clear image; and the short fiber layer which is efficiently transferred onto a subject receiver from a base sheet without remaining in the base sheet;

wherein complicated printing plate making processes and expertise in printing techniques are not needed to form the image layer compared with present printing techniques. Screen printing, offset printing and gravure printing and the art developed by this invention are in very inexpensive cost as compared to the prior art.

At the same time, the present invention suggests of a color electrophoto copying machine. The invention allows connection with computer data, so that an original design is copied and supplied by the machine. The design is represented in a fine toner image with so-called gradation effect in its designs, patterns, photos and letters in required colors.

The described invention shall greatly benefit present and relative industrial field for providing the present invention.

The foregoing description is a preferred embodiment of the disclosed device and various changes and modification may be made in the invention without departing from the spirit and scope thereof.

What is claimed is:

1. A transfer sheet comprising:

a hair transplant sheet having a base sheet, and an acrylic solvent cohesive layer parting layer on which a fiber layer is provisionally bonded;

a toner image fixed on the fiber layer of the hair transplant sheet by an electrophoto copying machine using a toner;

at least one acrylic ester resin binder layer which is placed on the fiber layer having the fixed toner image; and a hot-melt adhesive layer which is placed on the binder layer.

2. A transfer sheet comprising:

a hair transplant sheet having a base sheet, and an acrylic solvent cohesive layer parting agent on which a fiber layer which is separate from the base sheet is provisionally bonded;

a toner image fixed on the fiber layer of the hair transplant sheet by an electrophoto copying machine using a toner;

a transparent acrylic ester resin binder layer which is placed on the fiber layer having the fixed toner image;

a colored acrylic urethane resin which is placed on the transparent acrylic ester resin binder; and a hot-melt adhesive layer is also placed on the colored acrylic urethane layer.

3. A transfer sheet according to claim 1, wherein an electrophoto copying machine is a color copy machine using a toner.

4. A transfer sheet according to claim 2, wherein an electrophoto copying machine is a color copy machine using a toner.

5. A transfer sheet comprising:

a hair transplant sheet comprising an acrylic solvent cohesive layer parting agent on which a fiber layer is provisionally bonded which is placed onto a base sheet;

a toner image fixed on the fiber layer with a toner by a photo copying machine;

at least one acrylic ester resin layer binder layer placed on the fiber having the toner image; and a hot-melt adhesive layer also placed on the binder layer;

wherein the toner image and the fiber layer can be transferred on a subject receiver.

6. A transfer sheet comprising:

a hair transplant sheet comprising an acrylic solvent cohesive layer parting agent on which a fiber layer is provisionally bonded which is placed onto a base sheet;

a toner image fixed on the fiber layer with a toner by a photo copying machine;

a transparent acrylic ester resin layer as a binder layer placed on the short fiber having the fixed toner image;

a colored acrylic urethane resin layer placed on the transparent binder layer;

a hot-melt adhesive layer also placed on the colored layer; and wherein the toner image and the short fiber layer can be transferred on a subject receiver.

* * * * *